United States Patent [19]

Boucher

[11] Patent Number: 4,555,298

[45] Date of Patent: Nov. 26, 1985

[54] TAPE GUN

[75] Inventor: Ray Boucher, Perkinsfield, Canada

[73] Assignee: Bay Mills Limited, Canada

[21] Appl. No.: 611,716

[22] Filed: May 18, 1984

[51] Int. Cl.[4] ..... B44C 7/02

[52] U.S. Cl. ..... 156/523; 156/577; 156/579

[58] Field of Search ..... 156/523, 524, 526, 527, 156/574, 575, 577, 579, 71, 576

[56] References Cited

U.S. PATENT DOCUMENTS

| | | | |
|---|---|---|---|
| 1,967,748 | 7/1934 | Ehle | 156/523 |
| 3,404,060 | 10/1968 | Taylor, Jr. | 156/526 |
| 3,892,618 | 7/1975 | Griebat | 156/577 |
| 4,196,028 | 4/1980 | Mills et al. | 156/523 |
| 4,452,663 | 6/1984 | Heaton | 156/577 |

*Primary Examiner*—Michael Wityshyn

*Attorney, Agent, or Firm*—Kane, Dalsimer, Kane, Sullivan and Kurucz

[57] ABSTRACT

A device for dispensing and applying adhesive tape, for example drywall tape, from rolls as provided. The device comprises a frame consisting of a pair of spaced parallel arms connected to an elongated handle parallel thereto. A roller intermediate their free ends and the handle, between the arms supports a roll of the tape. An applicator roller is positioned transversely between the arms near their free ends to draw tape from the tape roll and to roll and press the tape, during use, into final position. The device further comprises a blade operatively positioned near the free ends of the arms and facing forwardly with respect to the arms, the blade being positioned transversely across them above the applicator roller. The blade is movable in a direction parallel to the arms between withdrawn position, wherein it does not obstruct the dispensing of tape from the device, and extended cutting position in which it extends forwardly from the ends of the arm beyond the applicator roller to permit cutting the tape transversely. A guide is secured to the arms near their free ends to receive tape from the roll and direct towards the ends of the arms below the applicator roller. This device provides a simple and effective mechanical means of applying adhesive drywall tape to drywall.

8 Claims, 3 Drawing Figures

TAPE GUN

BACKGROUND OF THE INVENTION

According to the present invention there is provided a device for dispensing and applying adhesive-type tape, for example fibreglass adhesive drywall tape, from rolls.

Tape dispensers to permit mechanical dispensing and application of tapes such as drywall tapes are known in the prior art. For example, Canadian Pat. No. 563,018 of Ames, issued Sept. 9, 1958, describes and illustrates a drywall tape dispenser in which tape is guided over a roller at the front end thereof, at which end mastic composition is fed onto the tape, and the mastic and tape are rolled onto drywall. A cutter blade mechanism is actuable to cut the tape as required. This device is fairly complicated, having many interrelated movable and working parts. The cutter mechanism operates at a 90° angle to the longitudinal axis of the device, and the plane of the tape is twisted 90° transversely between the supply roll of tape and the outlet end of the device. Fritzinger Canadian Pat. No. 797,645, issued Oct. 29, 1968, Neer U.S. Pat. No. 2,732,964, issued Jan. 31, 1956 and Connolly Canadian Pat. No. 422,848, issued Sept. 26, 1944 describe and illustrate other constructions of tape dispensers with cutting mechanisms, these patents being of general background interest.

Other patents of background interest describing commercial taping tools for drywall and the like include U.S. Pat. No. 1,967,748 of Ehle, issued July 24, 1934, U.S. Pat. No. 2,366,674 of Petty issued Jan. 2, 1945 and U.S. Pat. No. 2,288,987 of Allen issued July 7, 1942.

It is an object of the present invention to provide a mechanical dispenser and applicator device for adhesive drywall tape rolls, and other types of rolled tapes, which is relatively inexpensive to construct and has relatively few moving parts, and which is simple and effective in use.

SUMMARY OF THE INVENTION

According to the present invention there is provided a device for dispensing and applying adhesive tape, for example fibreglass adhesive drywall tape, from supply rolls. The device comprises a frame, the frame consisting of a pair of spaced parallel arms connected to an elongated handle parallel thereto. A roller supports rotatably a roll of the tape, between the arms and intermediate their free ends and the handle, the axis of rotation of the roller preferably being perpendicular to the longitudinal axis of arms and transverse thereto. An applicator roller is positioned transversely between the arms near their free ends. This roller is to roll and press the tape, during use, into final position and has a roller surface to frictional engage the tape as the roller rotates, to draw tape from the tape roll. A knife means is operatively positioned near the free ends of the arms, the knife means having a blade facing forwardly with respect to the arms and handle and being positioned transversely across the arms above the applicator roller. The knife means is movable in a direction parallel to the arms between withdrawn position, wherein the knife means does not obstruct the dispensing and applying of tape from the device, and extended cutting position in which the blade extends forwardly from the ends of the arms beyond the applicator roller to permit cutting the tape transversely. The knife means is biased towards extended cutting position, and is provided with a restraining means comprising a pawl pivotably secured to the frame to releasably engage the knife means to releasably hold it in withdrawn position. The restraining means is purposefully manipulable by the operating to release the knife means from being held by the restraining means. A guide means is provided secured to the arms near their free ends to receive tape from the roll and direct it towards the ends of the arms below the applicator roller.

The device according to the present invention provides a simple and effective mechanical means of applying fibreglass adhesive drywall tape from rolls. The device is simple to construct and effective in its operation. It has relatively few moving parts and provides direct and controlled dispensing of tape from the tape roll to the surface to be taped.

BRIEF DESCRIPTION OF THE DRAWINGS

These and other objects and advantages of the invention will become apparent upon reading the following detailed description and upon referring to the drawings in which.

Figure 1:
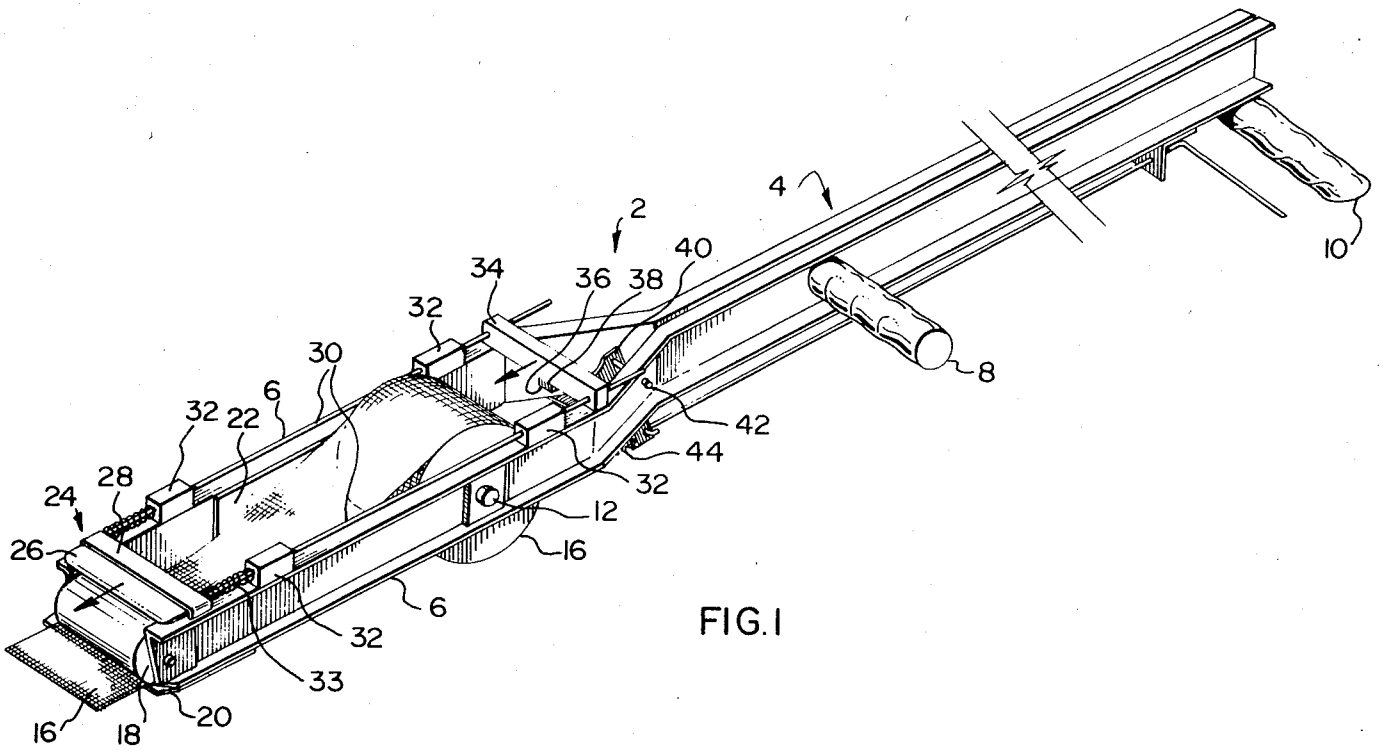
FIG. 1 is a perspective view of a tape dispensing and applying apparatus according to the invention.

While the invention will be described in conjunction with an example embodiment, it will be understood that it is not intended to limit the invention to such embodiment. On the contrary, it is intended to cover all alternatives, modifications and equivalents as may be included within the spirt and scope of the invention as defined by the appended claims.

DETAILED DESCRIPTION OF THE INVENTION

In the drawings similar features have been given similar reference numerals.

Turning to FIG. 1 there is illustrated a tape dispensing and applying device 2 according to the present invention comprising a handle 4 integrally secured to a pair of arms 6. Arms 6 are spaced equidistant on either side of handle 4 and lie in a direction parallel to that of handle 4. Handle 4 is provided with hand grips 8 and 10 to assist the operator in controlling the movement of the device.

Between arms 6 are rotatably secured support roller 12 for a roll of tape 16, and, at the free end of arms 6, applicator roller 18. Both of these rollers extend transversely between the arms, their axes of rotation lying perpendicular to the longitudinal axes of these arms. As will be described in more detail hereinafter, plate 20 spaced below applicator roller 18, is secured as illustrated at the free ends of arms 6, to guide tape 16 to applicator roller 18 and out of device 2. Plates 22, vertically secured to the inside surfaces of arms 6 as illustrated, between rollers 12 and 18, may be used as required to restrict the lateral movement of tape 16 during operation, and guide that tape in its longitudinal movement between these rollers.

Figure 2:
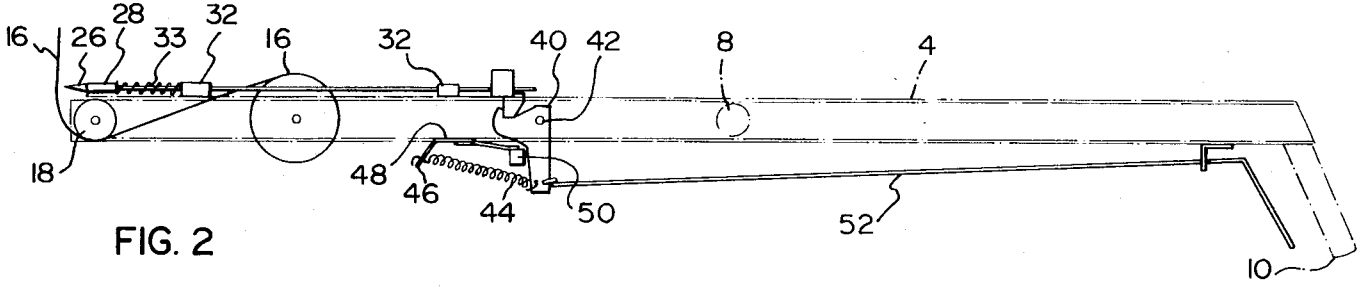
FIGS. 2 and 3 are schematic views of the cutter mechanism of the present invention, respectively in withdrawn and extended, cutting position.
Figure 3:
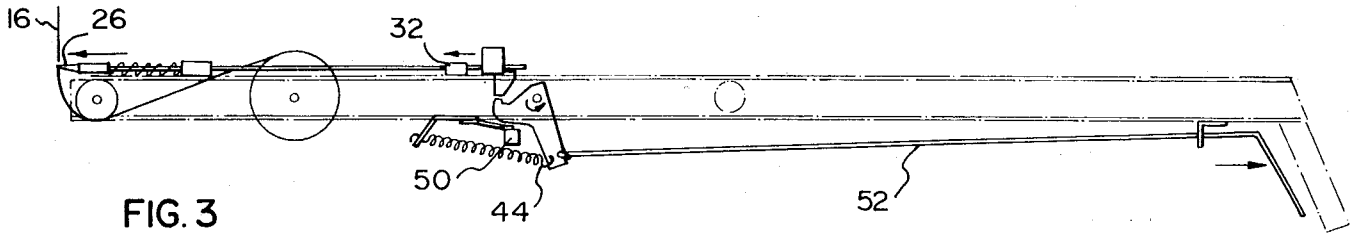

The device is further provided with a knife means or cutter mechanism 24 comprising a blade 26 secured in blade holder 28 for movement between withdrawn position, as illustrated in FIG. 2, in which the tape is free to be dispensed from the device, and extended cutting position as illustrated in FIG. 3 in which the blade extends outwardly from the ends of arms 6 beyond applicator roller 18 to transversely cut tape 16. Movement of cutter mechanism 24 is achieved by means of rods 30 slidable in a longitudinal direction parallel to the longitudinal axis of the arms, in guide blocks 32. Springs 33, bearing against the forward guide blocks 32 and the rear edge of blade holder 28 urge cutter mechanism 24 forwardly when in withdrawn position as shown in FIG. 2. Forward and rearward movement of rods 30 is similar and coordinated by transverse bar 34 secured to rear portions of rods 30. Cutter mechanism 24 is held in withdrawn position as illustrated, by means of catch 36 which extends downwardly from bar 34 and provides a forwardly facing bearing surface 38 against which pawl 40 catches. Pawl 40 is pivotably secured to the handle 4 (or, arms 6) as illustrated to pivot about pin 42 between catch engaging position (FIG. 2) and catch releasing position (FIG. 3). Spring 44, secured as illustrated to the lower end of pawl 40, and forwardly extending and secured to extension 46 of plate 48 secured to the bottom of arms 6, biases pawl 40 towards locking position as illustrated in FIG. 2, so that it will return, after release, to that position. The lower front portion of pawl 40 is prevented by stop 50 fixed to plate 48 from being rotated by spring 44 past this locking position, so that the pawl is in proper position to engage catch 36 when bar 34 (and rods 30 and cutter mechanism 24) are moved from cutting position into withdrawn position. To release pawl 40 from locking position with respect to catch 36, pawl rod 52 is connected to the bottom of pawl 40 and extends rearwardly, below handle 4, to end near hand grip 8. Pawl rod 52 is slidable when the operator draws rod 52 towards him at the handle end to pivot pawl 40 into disengaging position as illustrated in FIG. 3.

In operation, an appropriate roll of adhesive drywall tape 16 is secured on support roller 12 (which roller is of course detachably mounted on arms 6). Tape 16 is fed through the space between applicator roller 18 and plate 20. With the cutter mechanism 24 restrained in withdrawn position by pawl 40 (as illustrated in FIG. 2), the operator is ready to commence application of the drywall tape by rolling applicator roller 18 over the tape, at the front end of the device, while the tape is positioned over the area to be taped. Applicator roller 18 is provided with an outside coating, for example of sponge rubber, to assist in engaging tape 16 and drawing it from roll 14 during this process. The operator, while tape is rolled along the drywall seam, preferably holds one hand on hand grip 8 and the other on hand grip 10. Because of the central location of tape roll 16 and applicator roller 18 during operation of the device, and the symmetric construction of the device, even and firm pressure can be applied on the tape being rolled, by the operator, greatly assisting and facilitating the taping process. Of course, tape being applied sticks to the drywall and the operator applies pressure through applicator roller 18 during the taping process.

At the end of a seam, pawl rod 52 is pulled, pivoting pawl 40 about pin 42 and releasing the catch 36 from its engagement with pawl 40. Under urging from springs 33, blade 26 of cutter mechanism 24 is now thrust forwardly, beyond applicator roller 18, to severe tape 16 transversely, normal to its longitudinal axis.

Before the operator starts taping the next seam, cutter mechanism 24 is pulled back and again secured in withdrawn position (FIG. 2) by means of pawl 40 co-operating with catch 36. (Pawl 40 is held in this engaged position until the bias of spring 44 is again overcome when pawl rod 52 is pulled.) The operator then starts the next seam. This cycle is continued until the tape on the roll is used up. It is then replenished as described hereinbefore.

The tape dispensing and applying device of the present invention speeds up application of adhesive drywall tape. It is extremely simple to operate and provides a relatively simple construction with few moving parts. The device replaces what has heretofore been essentially a manual, non-mechanical operation in the trade, since prior art devices have proven either uneconomical or ineffective for this particular purpose.

Thus it is apparent that there has been provided in accordance with the invention a device for dispensing and applying adhesive tape from rolls that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. A device for dispensing and applying adhesive tape from rolls, the device comprising:

(a) a frame consisting of a pair of spaced parallel arms connected to an elongated handle parallel thereto;

(b) a roller supported between the arms intermediate their free ends and the handle to support rotatably a roll of said tape;

(c) an applicator roller positioned transversely between the arms near their free ends, this roller to roll and press the tape, during use, into final position and being provided with a roller surface to frictional engage the tape as the roller rotates, to draw tape from the tape roll;

(d) knife means operatively positioned near the free ends of the arms, having a blade facing forwardly with respect to the arms and handle and positioned transversely across the arms above the applicator roller, the knife means movable in a direction parallel to the arms between withdrawn position wherein the knife means does not obstruct the dispensing and applying of tape from the device, and extended cutting position in which the blade extends forwardly from the ends of the arms beyond the applicator roller to permit cutting the tape transversely the knife means being biased towards extending cutting position, and provided with restraining means comprising a pawl pivotably secured to the frame to releasably engage the knife means to releasably hold it in withdrawn position, the restraining means being purposefully manipulable by the operator to release the knife means from being held by the restraining means; and (e) guide means secured to the arms near their free end to receive tape from the roll and direct it towards the ends of the arms below the applicator roller.

2. A device according to claim 1 wherein the pawl is manipulable by means of rod means extending between the free end of the handle and the pawl.

3. A device according to claim 2 wherein movement of the knife means is controlled by a movement guide mechanism secured behind the blade, the movement guide mechanism consisting of a pair of spaced rods, secured to the knife means for sliding, simultaneous movement parallel to the longitudinal axis of the arms, the pawl mechanically engaging a transverse bar secured to the rods and extending transversely therebetween, to hold the knife in withdrawn position, the pawl being manipulable to disengage from this bar thereby freeing the knife means to move to cutting position.

4. A device according to claim 1 wherein the arms extend forwardly of the handle and are positioned equidistant to either side thereof.

5. A device according to claim 4 wherein the handle is provided with hand grips at the side and free end thereof.

6. A device according to claim 4 wherein the axis of rotation of the tape support roller is perpendicular to the longitudinal axis of the arms and transverse thereto.

7. A device according to claim 6 wherein the guide means to receive tape from the roll comprises a plate extending between the free ends of the arms, this plate being spaced below the applicator roller a sufficient amount to permit unobstructed passage of the tape between the plate and the applicator roller during operation of the device.

8. A device according to claim 6 wherein confronting, inner surfaces of the arms, between the two rollers are provided with guide means to constrict the lateral movement and direct the longitudinal movement of the tape during operation of the device.

* * * * *